US005975593A

United States Patent [19]

Cress

[11] Patent Number: 5,975,593

[45] Date of Patent: Nov. 2, 1999

[54] CABINET LATCH

[75] Inventor: David R. Cress, Janesville, Wis.

[73] Assignee: Newell Operating Company, Freeport, Ill.

[21] Appl. No.: 09/090,890

[22] Filed: Jun. 5, 1998

[51] Int. Cl.[6] ..... E05C 19/06

[52] U.S. Cl. ..... 292/86; 292/101; 292/255; 292/87

[58] Field of Search ..... 292/101, DIG. 55, 292/80, 86, 87, 255; 411/476, 482; 248/544, 546, 909; 70/466; 33/574, 671

[56] References Cited

U.S. PATENT DOCUMENTS

| | | | |
|---|---|---|---|
| 2,272,241 | 2/1942 | Fendring | 292/340 |
| 2,638,682 | 5/1953 | Russell | 33/574 |
| 3,980,326 | 9/1976 | Smith | 292/86 |
| 4,068,872 | 1/1978 | Smith | 292/87 |
| 4,109,950 | 8/1978 | Amdal | 292/254 |
| 4,139,249 | 2/1979 | Hillman | 312/333 |
| 4,686,769 | 8/1987 | Rock et al. | 33/197 |
| 4,895,401 | 1/1990 | Thornton et al. | 292/254 |
| 4,993,168 | 2/1991 | Acuna | 33/666 |
| 5,556,141 | 9/1996 | Rogers | 292/99 |
| 5,593,192 | 1/1997 | Stuchinsky | 292/207 |

FOREIGN PATENT DOCUMENTS

| | | |
|---|---|---|
| 24 44 546 | 5/1975 | Germany . |
| 63994 | 5/1947 | Norway . |

*Primary Examiner*—Teri Pham
*Attorney, Agent, or Firm*—Foley & Lardner

[57] ABSTRACT

A foot operated cabinet latch concealed in the cabinet kick-space of commonly used storage cabinets in, for example, kitchens and bathrooms. The cabinet latch has an operator knob located in the cabinet kick-space and a flexible lever and strike located inside the cabinet. Operation of the latch is accomplished by engaging a person's foot with the knob and pushing in an upwards direction. This action serves to disengage the lever from the strike and the cabinet door can then be opened.

19 Claims, 2 Drawing Sheets

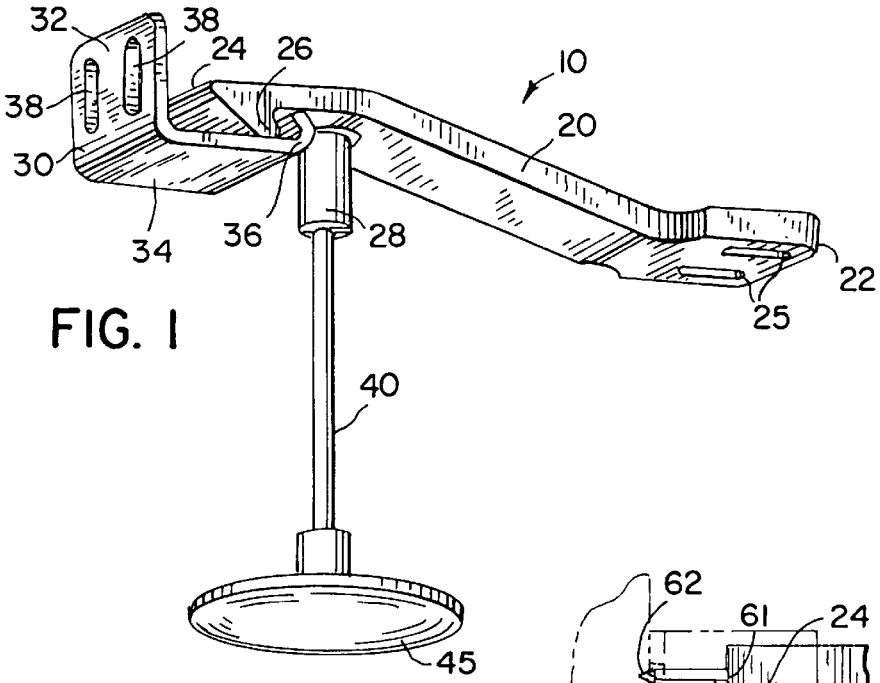
FIG. 1
FIG. 2
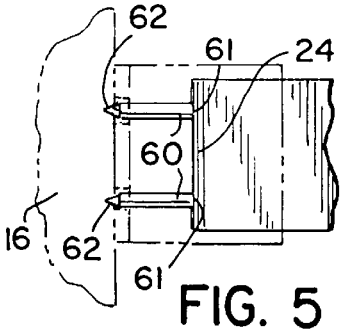
FIG. 5
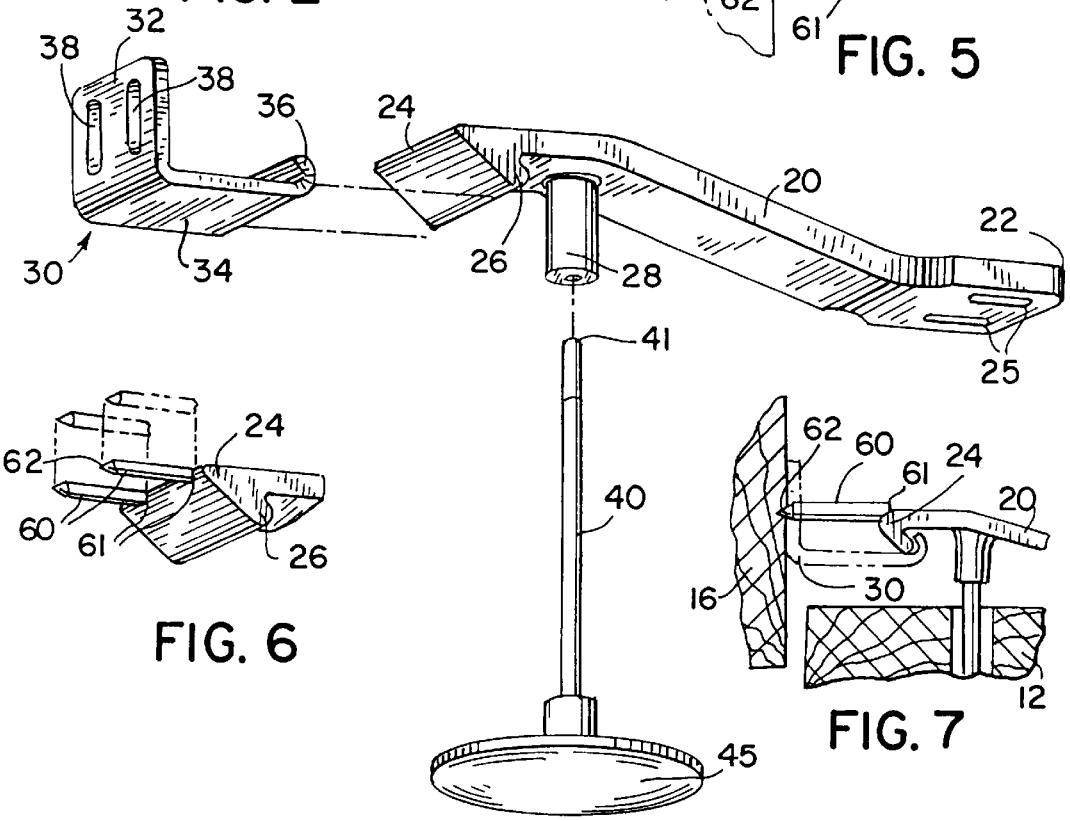
FIG. 6
FIG. 7

CABINET LATCH

FIELD OF THE INVENTION

The present invention relates to a cabinet door latch mounted within a cabinet and having a latch operator mechanism substantially exterior to the cabinet. Specifically, the present invention relates to a cabinet latch having a latch operator mechanism that is substantially concealed from view but readily accessible to an experienced operator. More specifically, the present invention relates to a cabinet latch mounted within a cabinet and having a toe-operated latch operator mechanism located in the kick-space at the lower portion of the cabinet, the latch operator mechanism is to be substantially concealed from view so that it is not readily apparent to an inexperienced operator.

BACKGROUND OF INVENTION

Various arrangements are known for latching a cabinet door in a closed position while being readily releasable. In a common arrangement a latch may consist of magnetically engaged members or frictionally engaged members, mounted on the cabinet door and frame. Some latches are operable by a simple handle pull and others are operable by actuating an operating mechanism. A disadvantage of latches having operating mechanisms is that the operating mechanisms are typically in plain view on the face of the cabinet door. Also, having the operation mechanism on the face of the door may be disadvantageous to a user with hands full. Therefore, the user would like the operation mechanism to be operated by something other than their hands, or the user would like the operation mechanism to be concealed from view. Another disadvantage of conventional latches is that the mounting positions are difficult to locate since they are concealed from view by the cabinet door. Still another disadvantage of many conventional latches is that they may be noisy when the cabinet door is closed.

Accordingly, it may be advantageous to have a cabinet latch mechanism that has an operation mechanism which is concealed from view. Further, it may be advantageous to have a cabinet latch mechanism that is foot operable and concealed from view in the cabinet kick-space. Still further, it may be advantageous to have a foot operable latch mechanism that is substantially concealed from view and can be more easily mounted than conventional latches. Still further, it may be advantageous to have a cabinet latch that is substantially quiet when the cabinet door is closed.

SUMMARY OF THE INVENTION

The present invention relates to a cabinet latch. The cabinet latch includes a strike adapted to be mounted on a cabinet door and extending therefrom and having a first engagement portion. The cabinet latch also includes a flexible lever having a first end and a second end, the lever being adapted to be mounted to a cabinet structure adjacent the first end, the lever also having a second engagement portion adjacent the second end, and the lever having an operator mechanism engagement site located between the first end and the second end. Further, the cabinet latch includes an operator mechanism having a first end and a second end, the first end of the operator mechanism being adapted to engage the operator mechanism engagement site, and the second end having a head portion. The operator mechanism is adapted to extend through the cabinet structure. The first engagement portion of the strike is configured to engage the second engagement portion of the lever when the cabinet door is substantially closed. The translation of the operator mechanism effectuates disengagement of the first and second engagement portions so that the cabinet door may be opened.

The present invention also relates to a cabinet latch for a cabinet. The cabinet has a cabinet door and a cabinet structure. The cabinet structure has a kick-space beneath the front edge of a bottom shelf and has a hole in the bottom shelf located over the kick-space. The cabinet latch includes a strike configured to be mounted on the cabinet door and extending therefrom, having a first engagement portion. The cabinet latch also includes a flexible lever having a first end and a second end, the lever configured to be mounted to a cabinet structure adjacent the first end, the lever having a second engagement portion adjacent the second end, and the lever having an operator mechanism rod located between the first end and the second end and extending therefrom. The cabinet latch further includes an operator head mountable to the operator mechanism rod opposite the flexible lever. The operator mechanism rod is adapted to extend through the hole in the bottom shelf of the cabinet so that the operator head is substantially located in the cabinet kick-space. The first engagement portion of the strike is configured to engage the second engagement portion of the lever when the cabinet door is substantially closed. The translation of the operator mechanism rod effectuates disengagement of the first and second engagement portions so that the cabinet door may be opened.

The present invention further relates to a method of mounting a substantially concealed cabinet latch to a cabinet including the steps of mounting a flexible lever inside of a cabinet, closing the cabinet door such that at least one strike point located on the free end of the flexible lever marks the inside face of the cabinet door, thereby providing an approximate location for a strike, and mounting the strike in the marked location.

BRIEF DESCRIPTION OF THE DRAWINGS

FIG. 1 is a perspective view of a cabinet latch having a strike, a lever, and an operator mechanism according to a preferred embodiment.

FIG. 2 is an exploded perspective view of the cabinet latch of FIG. 1.

FIG. 5 is a top view of the second end of the flexible lever, having two strike points according to an alternative embodiment.

FIG. 6 is a perspective view of the second end of the flexible lever having two strike points, as shown in FIG. 5.

FIG. 7 is a side elevation view of the latch showing the cabinet door in a closed position and showing the strike points marking the cabinet door.

DETAILED DESCRIPTION OF PREFERRED EXEMPLARY EMBODIMENTS

Referring to the FIGURES, preferred and alternative embodiments of a cabinet latch, with a substantially concealed operation mechanism is shown. It should be noted at the outset that the latch can be used with any of a wide variety of cabinet doors and other doors, such as overlay, inset and flush cabinet door arrangements, known to those skilled in the art who may review this disclosure.

Figure 3:
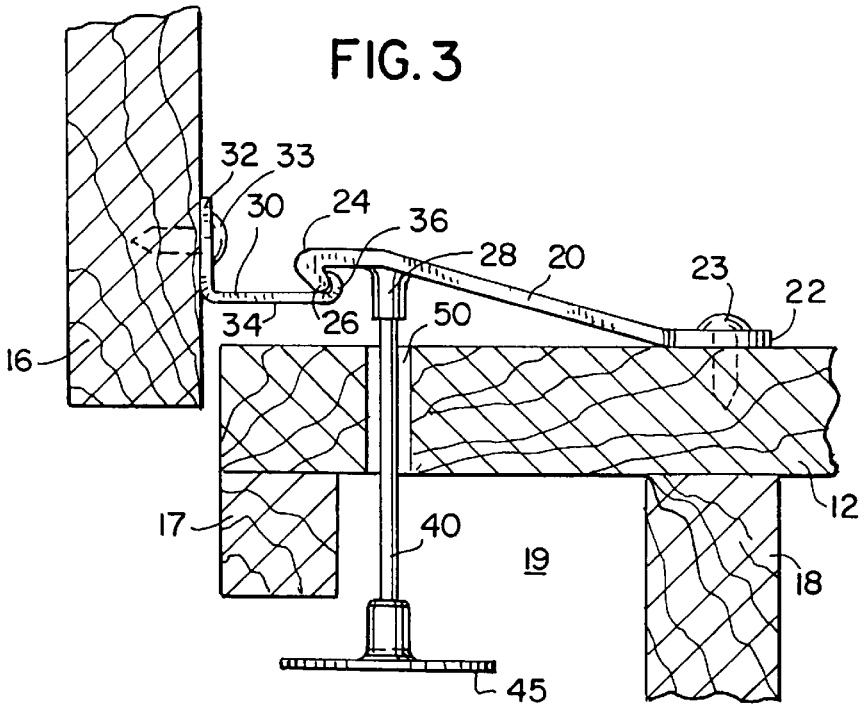
FIG. 3 is a side cross sectional view of a cabinet showing the cabinet latch installed and the cabinet door in the closed, latched position.
Figure 4:
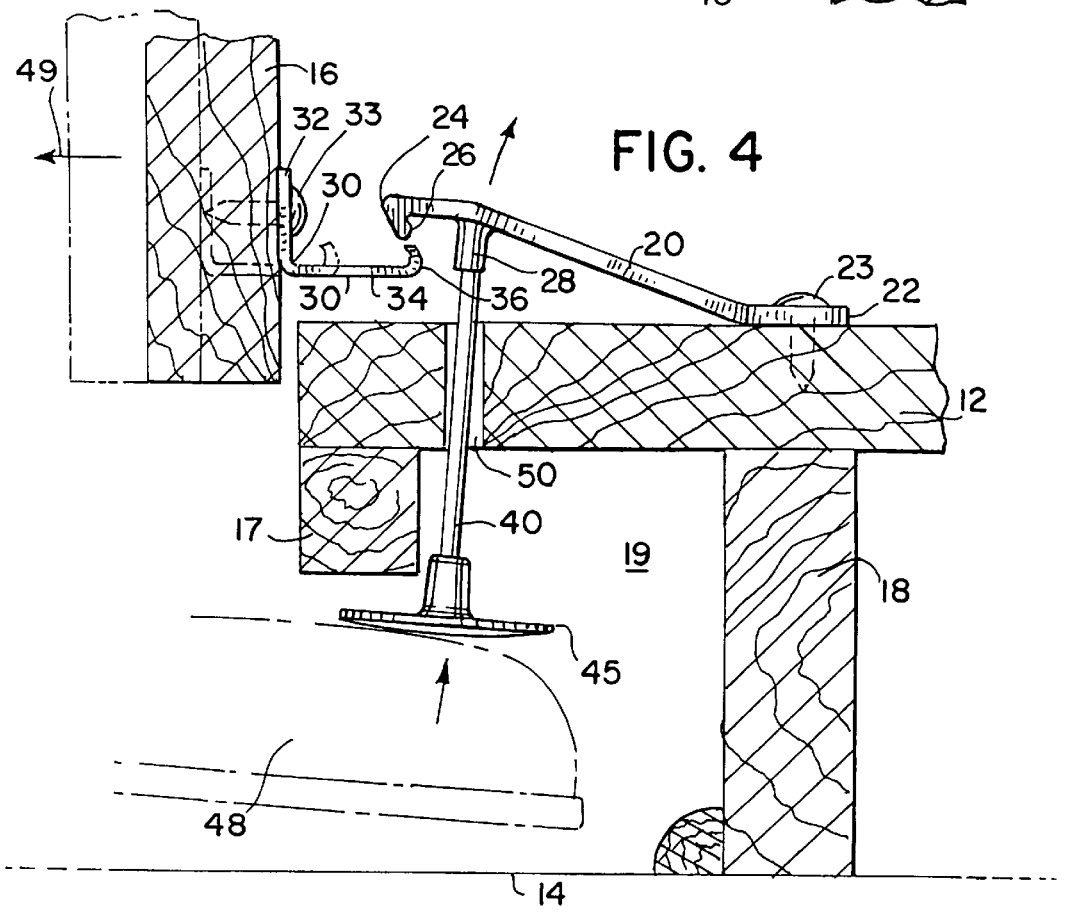
FIG. 4 is a side cross sectional view similar to FIG. 3, but showing the cabinet latch being released and the cabinet door opening.

Referring to FIG. 1, a preferred embodiment of a cabinet latch 10 is shown. Cabinet latch 10 may be used with any of a number of cabinets such as those commonly used in kitchens, bathrooms, workshops, and the like. As depicted in FIGS. 3 and 4, the cabinet has a bottom shelf 12, substantially parallel and above floor 14, a cabinet door 16, a trim piece 17 (alternative to trim piece 17 the cabinet may include a face frame or the cabinet may be a frameless cabinet), and a base support 18. Floor 14, trim 17, bottom shelf 12, and base support 18 define a kick-space 19.

Latch 10 is a cabinet door latch that, when the cabinet door is closed, may be substantially concealed from view, inside the cabinet and in kick-space 19, near the base of the cabinet. The latching mechanism, including a flexible lever 20 and a strike 30, is concealed within the cabinet. The operating mechanism, including a rod 40 (alternatively with a frameless cabinet a relatively shorter rod than is depicted in FIGS. 3 and 4 may be used) and a knob 45, extends from within the cabinet through a hole 50 in the bottom shelf of the cabinet, into a kick-space 19. The operating mechanism is at least partially concealed from view in kick-space 19, such that an inexperienced operator might not contemplate how the cabinet door may be opened, without experience or instruction.

As depicted in FIGS. 3 and 4, strike 30 is a substantially L-shaped strike attached to cabinet door 16. As depicted in FIG. 2, strike 30 has a mounting portion 32 and an extending portion 34. Extending portion 34 has a first engagement portion 36, depicted as a hook portion, designed to engage lever 20. Alternative to hook portion 36, the first engagement portion may be, but is not limited to, other geometries such as wedges, bumps, or dimples, that can be used to engage lever 20. In a preferred embodiment, strike 30 has two mounting slots 38. Mounting slots 38 are designed to accommodate wood screws 33 (depicted in FIGS. 3 and 4) for mounting strike 30 to door 16, however other mounting configurations may be used. Alternative to wood screws 33, any of a variety of fasteners can be used including nails, brads, and a variety of screws. Further, it is not necessary that strike 30 have mounting slots 38, rather strike 30 may be mounted using an adhesive or strike 30 may have extending teeth which are driven into cabinet door 16. Strike 30 is preferably made from a polymeric or metallic composition but other materials, with substantial rigidity, may be used.

As depicted in FIGS. 1 through 4, flexible lever 20 is a slightly elongate member having a first end 22 and a second end 24. Adjacent first end 22, lever 20 preferably has two mounting slots 25. Mounting slots 25 are configured to accommodate wood screws 23 (depicted in FIGS. 3 and 4) for mounting lever 20 to bottom shelf 12, however other mounting configurations may be used. For example, any of a variety of fasteners can be used including nails, brads, and a variety of screws. Also, it is not necessary that lever 20 have mounting slots 25, rather lever 20 may be mounted using an adhesive or lever 20 may have extending teeth which are driven into bottom shelf 12. Adjacent second end 24 of lever 20 is a second engagement portion 26. Second engagement portion 26 is configured to engage first engagement portion 36 of strike 30 when cabinet door 16 is in a closed position, as depicted in FIG. 3. Second engagement portion 26 is depicted as a hook portion or a lip, alternatively, other types of engagement surfaces may be used such as, but not limited to, protrusions, bumps, depressions, or teeth. Second engagement portion 26 is configured to engage with first engagement portion 36 such that a door operator is substantially prevented from opening cabinet door 16 without first disengaging second engagement portion 26 from first engagement portion 36.

Flexible lever 20 is preferably made from an Acetal thermoplastic material, however, lever 20 may be manufactured from any suitable material, including, but not limited to other polymeric materials, metals and metal alloys, ceramics, and composite materials. Having flexible lever 20 made from a polymeric material, such as Delrin 500p, an Acetal thermoplastic, has the advantage of creating a quieter latch than conventional latches having metal to metal engagements. The combination of an Acetal thermoplastic lever 20 and a metal strike 30 also provides better wear resistance and longer life, because Acetal is a self-lubricating bearing material. As depicted in FIGS. 1 through 4, lever 20 has an operator mechanism engagement site or mount, shown as a collar 28. Collar 28 is designed to connect with rod 40 at a first end 41. Preferably, collar 28 has an aperture into which rod 40 is affixed using an interference fit. Alternatively, collar 28 may have an aperture into which rod 40 is affixed using heat, or an adhesive. Further, Collar 28 may alternatively have an interior thread and correspondingly first end 41 of rod 40 may have an exterior thread, such that rod 40 may be screwed into collar 28 during assembly to join the two parts. Another alternative is that flexible lever 20 and rod 40 be manufactured as a single unit. As depicted in FIGS. 3 and 4, rod 40 extends through aperture 50 in bottom shelf 12, into kick-space 19. Rod 40 preferably has a head portion or knob 45 attached to a second end of rod 40. Knob 45 resides in kick-space 19. Knob 45 is designed to be comfortable (e.g., spherical, hemispherical, rounded, flat, or cupped) for engagement with an operator's foot 48, as depicted, in phantom, in FIG. 4.

In operation, an operator desiring to open cabinet door 16 engages foot 48 with knob 45 as shown in FIG. 4. The operator pushes knob 45 in a substantially upward direction, thereby substantially translating rod 40 through hole 50 in an upwards direction. Rod 40, being connected to or engaging lever 20, forces lever 20 to be deformed, thereby causing second end 24 to move in a substantially upwards direction. When end 24 moves in a substantially upwards direction, second engagement portion 26 becomes disengaged from first engagement portion 36. At this point, door 16 may be freely moved in a direction 49. The force necessary for an operator to operate latch 10 may be increased by increasing the thickness of lever 20 or the force may be decreased by decreasing the thickness of lever 20.

In an alternative embodiment of the present invention, second end 24 of lever 20 has two strike points 60 (or marking pins), depicted in FIGS. 5 through 7. Strike points 60 each have a first end 61, attached to second end of lever 20, and a second end 62 having a pointed tip. Strike points 60 may be integrally molded with lever 20 of a polymer material. Alternatively, strike points 60 may be manufactured from other substantially rigid materials, including but not limited to metals, metal alloys, composites, and ceramics. Also, strike points 60 may be manufactured separately from lever 20 and later affixed to lever 20. Strike points 60 are used to facilitate installation of cabinet latch 10, by making it simpler to locate the position of strike 30.

Installation of conventional latches requires the need for complicated measurements or templates to locate the strike. In a preferred embodiment of the present invention, strike points 60 simplify the process of installation by reducing the need for complicated measurements. To install latch 10, a person first mounts flexible lever 20 in an appropriate position to shelf 12 by screws 23. The installer then closes cabinet door 16 such that strike points 60 indent the inner face of cabinet door 16. The marks or indentations on the cabinet door indicate the approximate position for mounting strike 30 to cabinet door 16, without making measurements. Some door materials may resist indentation by strike points 30 in which case a marking substance may be placed on second end 62 of strike points 60. The marking material to be used may be any of a variety of marking substances, including but not limited to ink, wax, lipstick, shoe polish, water, charcoal, and chalk. After door 16 has been appropriately marked and strike 30 has been appropriately mounted, strike points 60 may be broken off of second end 24 of lever 20. Second end 24 of lever 20 may then be sanded smooth if desired.

It is understood that, while the detailed drawings and specific examples given describe preferred exemplary embodiments of the present invention, they are for the purpose of illustration only. The apparatus and method of the invention is not limited to the precise details and conditions disclosed. For example, although an overlay door is depicted in the FIGURES, the present invention may be applied to other door configurations. Also, although the latch mechanism is depicted as having the operation mechanism in the kick-space, other locations for the latch and operation mechanism may be used. Various changes may be made to the details disclosed without departing from the spirit of the invention, which is defined by the following claims.

What is claimed is:

1. A cabinet latch for installation on a cabinet door, comprising:

a strike adapted to be mounted on the cabinet door and extending therefrom, having a first engagement portion;

a flexible lever having a first end and a second end, the lever adapted to be mounted to a cabinet structure adjacent the first end, the lever having a second engagement portion adjacent the second end, and the lever having an operator mechanism engagement site located between the first end and the second end;

an operator mechanism having a first end and a second end, the first end of the operator mechanism being adapted to engage the operator mechanism engagement site, and the second end of the operator mechanism having a head portion;

wherein the second end of the flexible lever includes at least one strike point adapted to mark the cabinet door to indicate the approximate location at which to mount the strike; and wherein the operator mechanism is adapted to extend through an aperture in a wall of the cabinet structure, the first engagement portion of the strike is configured to engage the second engagement portion of the lever when the cabinet door is substantially closed, and the translation of the operator mechanism effectuates disengagement of the first and second engagement portions so that the cabinet door may be opened.

2. The cabinet latch of claim 1, wherein the flexible lever is manufactured from a substantially polymeric material.

3. The cabinet latch of claim 1, wherein there are two strike points.

4. The cabinet latch of claim 1, wherein the at least one strike point is frangibly connected to the flexible lever.

5. The cabinet latch of claim 1, wherein the at least one strike point is substantially made of a polymer.

6. The cabinet latch of claim 1, wherein the first end of the operator mechanism is coupled to the flexible lever.

7. A cabinet latch for a cabinet, the cabinet having a cabinet door and a cabinet structure, the cabinet structure having a kick-space beneath the front edge of a bottom shelf and having an aperture in the bottom shelf located over the kick-space, the cabinet latch comprising:

a strike configured to be coupled to the cabinet door and extending therefrom, having a first engagement portion;

a flexible lever having a first end and a second end, the lever configured to be coupled to the cabinet structure adjacent the first end, the lever having a second engagement portion adjacent the second end, and the lever having an operator mechanism rod located between the first end of the lever and the second end of the lever, extending therefrom;

an operator head adapted to be coupled to the operator mechanism rod opposite the flexible lever; and at least one strike point extending from the second end of the flexible lever adapted to mark the inside face of the cabinet door to indicate the approximate location at which to mount the strike;

wherein the operator mechanism rod is adapted to extend through the aperture in the bottom shelf of the cabinet so that the operator head is substantially located in the cabinet kick-space, the first engagement portion of the strike is configured to engage the second engagement portion of the lever when the cabinet door is substantially closed, and the translation of the operator mechanism rod effectuates disengagement of the first engagement portion of the strike from the second engagement portion of the lever so that the cabinet door may be opened.

8. The cabinet latch of claim 7 wherein the flexible lever has at least one aperture adjacent the first end, to accommodate at least one mounting fastener.

9. The cabinet latch of claim 7, wherein the operator mechanism rod is coupled to the operator head with an interference fit.

10. The cabinet latch of claim 7, wherein the at least one strike point is made of a polymeric material.

11. The cabinet latch of claim 7 wherein the at least one strike point is frangibly connected to the flexible lever.

12. The cabinet latch of claim 7 wherein there are two strike points extending from the second end of the flexible lever.

13. The cabinet latch of claim 7, wherein the operator head is coupled to the operator mechanism rod using an adhesive.

14. The cabinet latch of claim 7, wherein the flexible lever and the at least one strike point are manufactured as a single unit.

15. A cabinet latch for a cabinet, the cabinet having a cabinet door and a cabinet structure, the cabinet structure having a kick-space beneath the front edge of a bottom shelf and having an aperture in the bottom shelf located over the kick-space, the cabinet latch comprising:

a strike configured to be coupled to the cabinet door and extending therefrom, having a first engagement portion;

a flexible lever having a first end and a second end, the lever coupled to the cabinet structure adjacent the first end, the lever having a second engagement portion adjacent the second end, and the lever having an operator mechanism rod located between the first end of the lever and the second end of the lever, extending from and coupled to the lever;

at least one strike point extending from the second end of the flexible lever adapted lo mark the cabinet door to indicate the approximate location at which to mount the strike; and operator head coupled to the operator mechanism rod opposite the flexible lever;

wherein the operator mechanism rod extends through the aperture in the bottom shelf of the cabinet so that the operator head is substantially located im the cabinet kick-space, the first engagement portion of the strike is configured to engage the second engagement portion of the lever when the cabinet door is substantially closed, and the translation of the operator mechanism rod through the aperture effectuates disengagement of the first engagement portion of the strike from the second engagement portion of the lever so that the cabinet door may be opened.

16. The cabinet latch of claim 15, wherein the at least one strike point is one of a marker and a marking pin.

17. The cabinet latch of claim 15 wherein there are two strike points extending from the second end of the flexible lever.

18. The cabinet latch of claim 15 wherein the at least one strike point is frangibly connected to the flexible lever.

19. A latch for installation on one of a door and a door frame, comprising:

a strike having a first engagement portion and being configured to be mounted on one of the door and the door frame;

a lever having a first end and a second end with a second engagement portion adjacent the second end and being configured to be mounted on the other of the door and the door frame; and at least one strike point included on one of the strike and the lever adapted to mark one of the door and the frame to indicate the approximate location at which to mount the other of the strike and the lever;

wherein the first engagement portion is configured to engage the second engagement portion.

* * * * *

UNITED STATES PATENT AND TRADEMARK OFFICE

CERTIFICATE OF CORRECTION

PATENT NO. : 5,975,593

DATED : Nov. 2, 1999

INVENTOR(S) : Cress

It is certified that error appears in the above-identified patent and that said Letters Patent is hereby corrected as shown below:

Claim 15, col. 6, line 65, please delete "lo" and insert therefor --to--; and
Claim 15, col. 7, line 5, please delete "im" and insert therefor --in--.

Signed and Sealed this

Thirtieth Day of May, 2000

*Attest:*

Q. TODD DICKINSON

*Attesting Officer*

*Director of Patents and Trademarks*